US007244165B2

(12) United States Patent
Gubitosi et al.

(10) Patent No.: US 7,244,165 B2
(45) Date of Patent: Jul. 17, 2007

(54) ENTERTAINMENT TOY HAVING MULTIPLE CONFIGURATIONS

(75) Inventors: Domenic T. Gubitosi, East Aurora, NY (US); Brian S. Kelly, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/235,837

(22) Filed: Sep. 6, 2002

(65) Prior Publication Data

US 2004/0048547 A1 Mar. 11, 2004

(51) Int. Cl.
*A63H 33/00* (2006.01)

(52) U.S. Cl. ..... 446/175; 446/227; 482/35; 297/136

(58) Field of Classification Search ..... 472/135, 472/64; 482/66, 35; 297/136, 137; 446/227, 446/175, 143, 397, 408; 84/718, 719, 720, 84/721, 743, 744, 745, 746, 600
See application file for complete search history.

(56) References Cited

U.S. PATENT DOCUMENTS

| | | | | |
|---|---|---|---|---|
| 1,294,300 | A | | 2/1919 | Noel, Sr. |
| 1,419,890 | A | | 6/1922 | Noel, Sr. |
| 2,766,464 | A | | 10/1956 | Savi |
| 3,454,272 | A | | 7/1969 | Elkington et al. |
| 3,749,810 | A | | 7/1973 | Dow |
| 3,775,546 | A | | 11/1973 | Honegger |
| 3,922,944 | A | * | 12/1975 | Kurosaki et al. ..... 84/721 |
| 4,121,488 | A | | 10/1978 | Akiyama |
| 4,627,588 | A | * | 12/1986 | Block ..... 446/227 |
| 4,777,856 | A | | 10/1988 | Liu et al. |
| 4,795,151 | A | | 1/1989 | Mulcaster |
| D313,238 | S | * | 12/1990 | Saraceni ..... D17/7 |
| 5,071,149 | A | | 12/1991 | Perego |
| 5,154,658 | A | | 10/1992 | Marcus |
| 5,211,607 | A | | 5/1993 | Fermaglish et al. |

(Continued)

FOREIGN PATENT DOCUMENTS

| | | |
|---|---|---|
| EP | 0 257 311 A2 | 3/1988 |
| EP | 0 549 544 A1 | 6/1993 |
| FR | 1 319 250 | 1/1963 |

OTHER PUBLICATIONS

Descriptive page for Super Bouncing Buggy by Safety 1st, from BabyCenter web site, www.store.babycenter.com. p. 1, printed Jan. 14, 2002.

Graco "Littel Tikes" Entertainer Owner's Manual, Aug. 2002, available at http://www.gracobaby.com/assets/pdfs/instructions/ISPE002AA.pdf, pp. 1–24.

Graco "Nursey Rhyme Entertainer 4654" Owners Manual, May 2002 available at http://www.gracobaby.com/assests/pdfs/instructions.664–05–05.pdf, pp. 1–32

*Primary Examiner*—Derris H. Banks
*Assistant Examiner*—Urszula M Cegielnik
(74) *Attorney, Agent, or Firm*—Cooley Godward LLP

(57) ABSTRACT

An entertainment toy that can be disposed in multiple configurations is disclosed. In one embodiment, the entertainment toy includes a base having an upper surface, a support frame coupled to the base, and a seat that is configured to hold an infant. The seat is movably mounted on the support frame. The entertainment toy includes an output generating system. In one embodiment, the entertainment toy includes an actuator disposed on the base. The actuator is connected to the output generating system and is disposed to be engaged by a foot of the infant. The output generating system is configured to generate audible and/or visual outputs in response to activation of the actuator.

25 Claims, 7 Drawing Sheets

U.S. PATENT DOCUMENTS 5,362,272 A 11/1994 Chow et al.
5,382,033 A 1/1995 Cheu
5,490,784 A * 2/1996 Carmein ..... 434/55
D369,685 S * 5/1996 Meeker et al. ..... D21/412
5,522,782 A 6/1996 Kurtin et al.
D375,283 S 11/1996 Lu
5,700,201 A 12/1997 Bellows et al.
D390,888 S * 2/1998 Meeker et al. ..... D21/414
D391,531 S 3/1998 Mak
5,728,030 A 3/1998 Hsieh
D395,467 S 6/1998 Bellows
5,788,253 A 8/1998 Thomson et al.
5,803,835 A 9/1998 Moton et al.
D402,931 S 12/1998 Huang
5,930,854 A 8/1999 O'Neill et al.
5,934,747 A * 8/1999 Garland ..... 297/136
5,971,761 A 10/1999 Tillman, Sr.
5,980,256 A * 11/1999 Carmein ..... 434/55
6,000,750 A 12/1999 Rossman et al.
6,001,047 A 12/1999 Ferrara
6,048,290 A 4/2000 Chen et al.
6,066,022 A 5/2000 Fobean et al.
6,178,978 B1 1/2001 Rieber
6,206,384 B1 3/2001 Chi et al.
6,296,268 B1 10/2001 Ford et al.
6,332,824 B2 * 12/2001 Tell et al. ..... 446/227
6,422,941 B1 * 7/2002 Thorner et al. ..... 463/30
6,540,579 B1 * 4/2003 Gubitosi et al. ..... 446/227

* cited by examiner

ENTERTAINMENT TOY HAVING MULTIPLE CONFIGURATIONS

BRIEF DESCRIPTION OF THE INVENTION

This invention relates generally to toys. More specifically, this invention relates to entertainment toys having multiple configurations.

BACKGROUND OF THE INVENTION

Conventional walker toys are used to teach young children how to walk. Many such walker toys include entertainment and amusement features. However, the usefulness of such toys and the level of interest of children in such toys often decrease as children learn how to walk. Conventional walker toys typically do not have multiple configurations that allow children of different skills to use the toy.

Children in various phases of development are typically interested in different toys. For example, infants are usually interested in a simple toy that needs few motor skills to use, such as a rattle. Older children are usually interested in more complex toys that are better adapted to their abilities to walk, climb, or move around.

Thus, a need exists for a walker toy that amuses, educates, and/or entertains children at various stages of development. A need also exists for a walker toy that has multiple configurations, some of which are designed for younger children and some of which are designed for older children. Such a walker toy can be reconfigured to adjust to the child as the child grows, thus extending the usefulness of the toy and reducing costs for parents or caregivers.

SUMMARY OF THE INVENTION

The present invention relates to an entertainment toy for children. In one embodiment, the entertainment toy can be disposed in multiple configurations. In one configuration, the entertainment toy resembles a walker toy. In one embodiment, the entertainment toy includes a base having an upper surface, a support frame coupled to the base, and a seat that is configured to hold an infant. The seat may be movably mounted on the support frame.

The entertainment toy may include an output generating system. In one embodiment, the entertainment toy includes an actuator disposed on the base. The actuator is connected to the output generating system and is disposed to be engaged by a foot of the infant. The output generating system is configured to generate audible and/or visual outputs in response to activation on of the actuator.

DETAILED DESCRIPTION OF THE INVENTION

The present invention relates to an entertainment toy for children. In one embodiment, the entertainment toy can be disposed in multiple configurations. In one configuration, the entertainment toy resembles a walker toy. In one embodiment, the entertainment toy includes a base having an upper surface, a support frame coupled to the base, and a seat that is configured to hold an infant. The seat is movably mounted on the support frame.

The entertainment toy includes an output generating system. In one embodiment, the entertainment toy includes an actuator disposed on the base. The actuator is connected to the output generating system and is disposed to be engaged by a foot of the infant. The output generating system is configured to generate audible and/or visual outputs in response to activation of the actuator.

Figure 1:
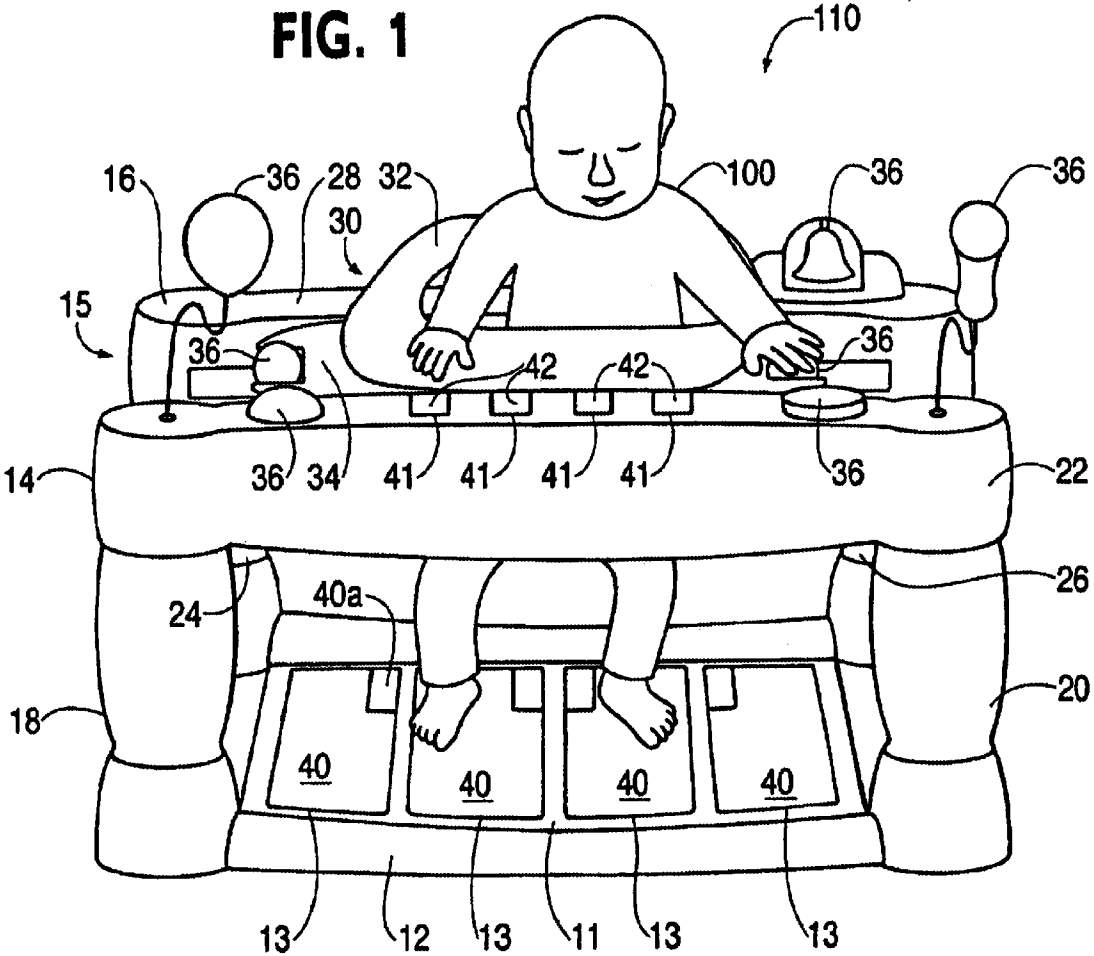
FIG. 1 illustrates a perspective view of an entertainment toy in a first configuration according to the present invention.

FIG. 1 illustrates a perspective view of an entertainment toy constructed in accordance with the present invention. In the illustrated embodiment, the toy 10 includes a base 12, a support frame 15 that includes supports or support members 14 and 16, and a seat assembly 30. Support frame 15 supports the seat assembly 30 for movement along the supports 14 and 16. In the illustrated embodiment, the supports 14 and 16 are arranged substantially parallel to each other. Each of the supports 14 and 16 can be also referred to as a frame portion of support frame 15.

In the illustrated embodiment, support member 14 includes posts 18 and 20 and a rail 22. The posts 18 and 20 are coupled to the base 12 and to the rail 22. Similarly, support member 16 includes posts 24 and 26 and a rail 28. The posts 24 and 26 are coupled to the base 12 and to the rail 28. Attached to each of the rails 22 and 28 are several amusement devices 36. The amusement devices 36 can be placed on the upper surface of the rails 22 and 28. The amusement devices 36 can be any type of amusement devices, such as rattles, spinners, clickers, drums, etc.

The seat assembly 30 includes a seat 32 and a seat frame 34. The seat 32 is configured to hold an occupant, such as a child. The seat frame 34 is slidably and removably coupled to the rails 22 and 28. The seat assembly 30 is also configured to allow the seat 32 to swivel and to be raised or lowered relative to the base 12. The sliding, swiveling, and height adjustment features of the seat assembly 30 are discussed in further detail below.

In the illustrated embodiment, the entertainment toy 10 includes an output generating system. The output generating system includes several input mechanisms and several output mechanisms. In one embodiment, the input mechanisms include several actuators or pedals 40 that are coupled to the base 12. As illustrated in FIG. I, the base 12 includes an upper surface 11 and several openings 13 formed in the upper surface 11 of the base 12. Each pedal 40 is mounted for movement in an opening 13 on the base 12.

The input mechanisms also include several actuators or keys 42 that are coupled to rail 22. In the illustrated embodiment, each key 42 is movably mounted in an opening 41 on the rail 22. In one embodiment, the pedals 40 and keys 42 resemble the keys of a musical instrument, such as a piano. The pedals 40 and keys 42 can be referred to as movable members.

The toy 10 includes output devices, such as lights and /or a sound generating system, so that pressing one or more of the pedals 40 or keys 42 causes visual and/or audible outputs to be generated. The operations of pedals 40, keys 42, and the output generating system are described in greater detail below.

In the illustrated embodiment, the entertainment toy 10 has multiple configurations. FIG. 1 illustrates an exemplary first configuration 110 of the toy 10. In this configuration 110, the toy 10 can function as a walker toy by providing support for a child that cannot walk so that the child can move along the toy 10. The entertainment toy 10 can be used to assist young children in learning how to walk by providing a frame 15 that allows them to slide along the rails 22 and 28 of the toy 10. A child 100 can be placed in the seat 32, which is supported on a seat frame 34 that slides back and forth along the rails 22 and 28. Hence, the child 100 can move from a first position over one of the pedals 40 to a second position over a different pedal 40 or no pedal at all. As illustrated, the child 100 in the seat 32 can actuate each pedal 40 with its feet.

In one embodiment, the seat 32 is pivotally mounted on the seat frame 34 and allows the child 100 to swivel so as to face either rail 22 or 28. Accordingly, the child 100 has access to the amusement devices 36 and keys 42.

In one embodiment, the height of the seat 32 can be adjusted relative to the base 12. The seat 32 includes a height adjustment mechanism, which is described in detail below. The height adjustment mechanism allows children of varying heights to use the toy 10 in the first configuration 110.

Figure 2:
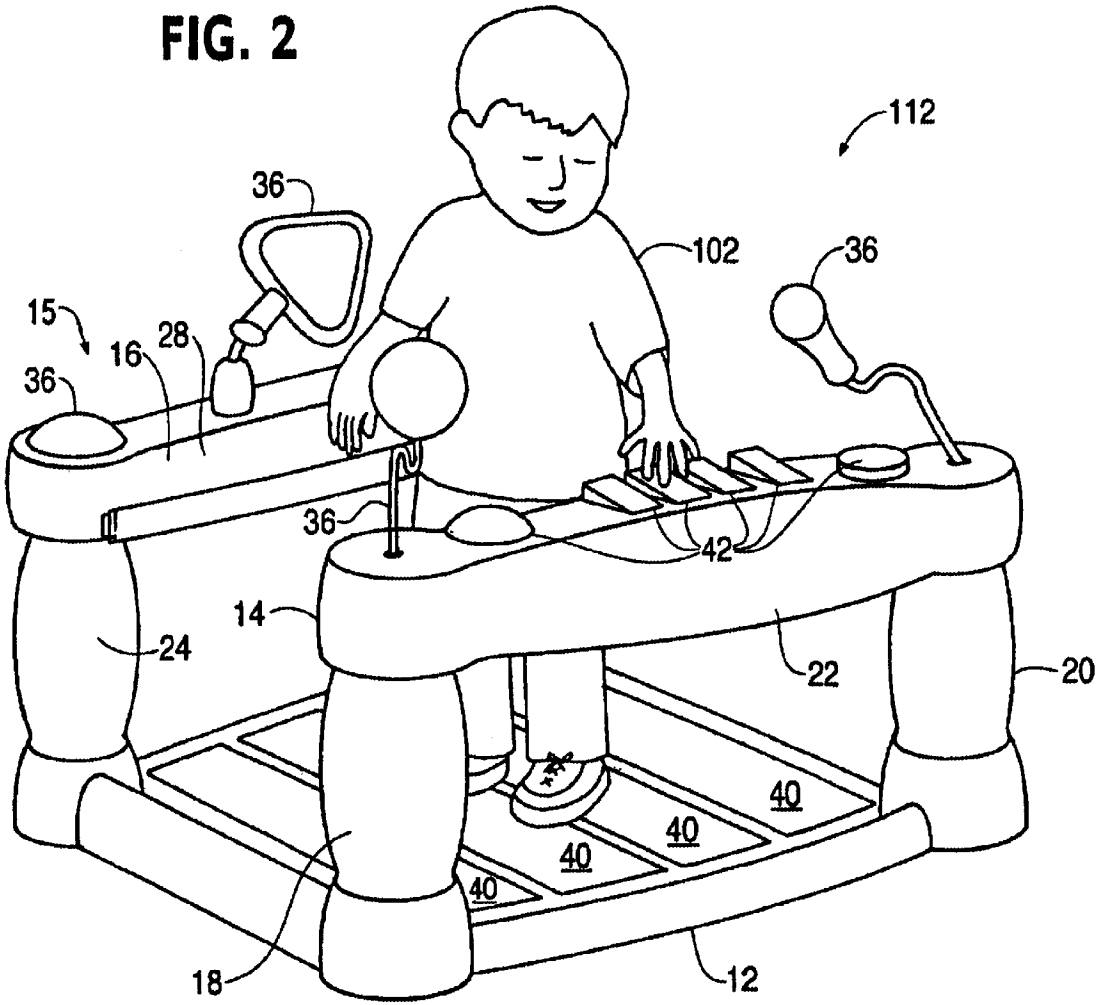
FIG. 2 illustrates a perspective view of the entertainment toy of FIG. 1 in a second configuration.

Children typically have no need for walker-type toys once they learn how to walk. In one embodiment, the entertainment toy 10 includes a second configuration that allows children to walk along the toy. FIG. 2 illustrates a second configuration 112 of the toy 10. In this configuration 112, the seat assembly 30 is removed from the rails 22 and 28. When the seat assembly 30 is removed, a child 102 is free to walk between the rails 22 and 28 and actuate the pedals 40 and/or keys 42 without the assistance of the seat 32.

Figure 3:
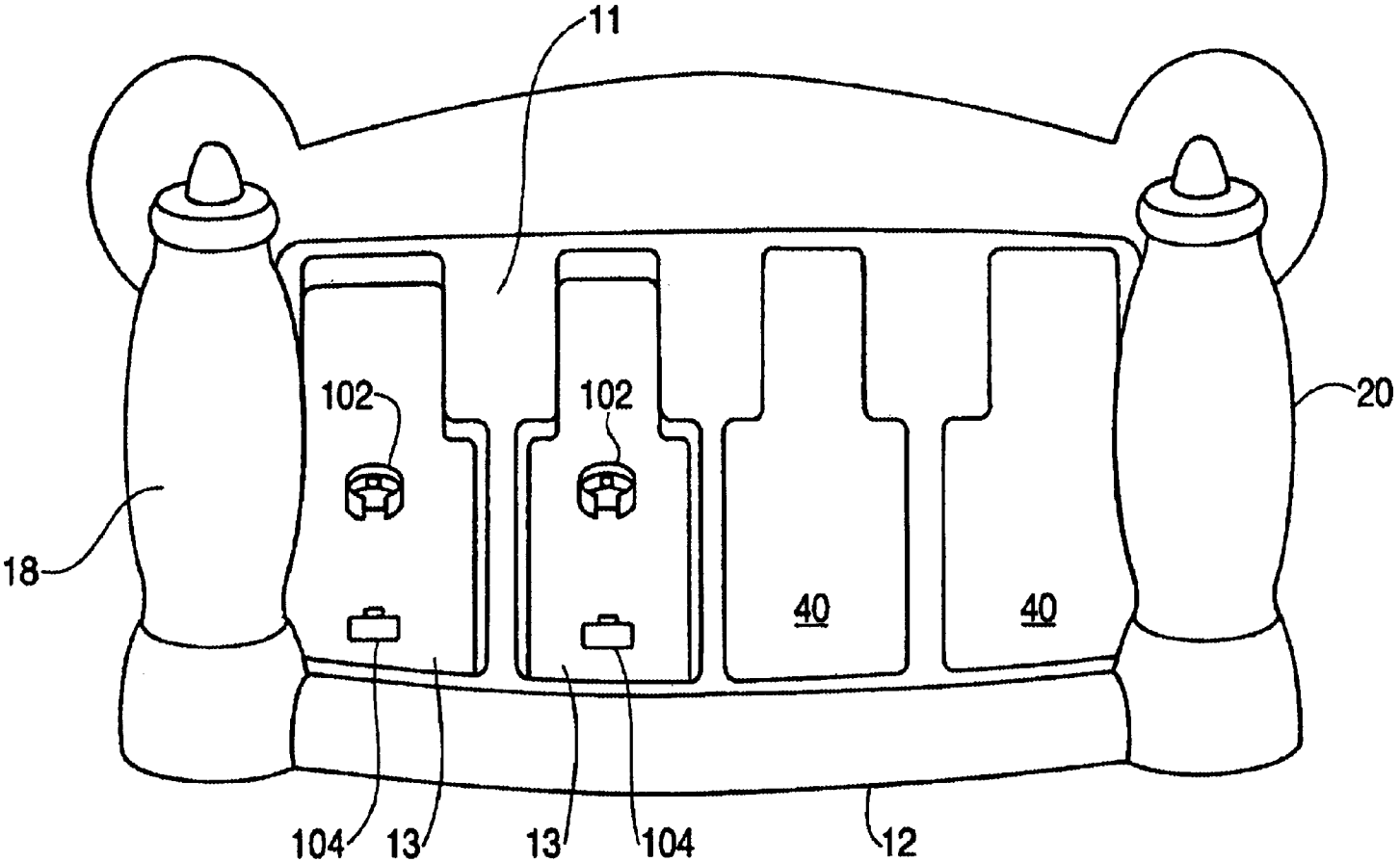
FIG. 3 illustrates a perspective cutaway view of some of the components of the entertainment toy of FIG. 1.

FIG. 3 illustrates a perspective cutaway view of an embodiment of the base 12. As noted above, the base 12 includes several openings 13 in which actuators 40 are mounted. In order to facilitate the description of the operation of the actuators 40, two of the actuators 40 are removed from the base 12 in FIG. 3.

In the illustrated embodiment, the base 12 includes a fulcrum point 102 and switch 104 within each opening 13. Each fulcrum point 102 and switch 104 is located under a pedal 40. Switches 104 can be any conventional switches, such as a metal contact switches.

Each pedal 40 is pivotally coupled to a fulcrum point 102 in an opening 13. A conventional biasing mechanism, such as a spring, can be used to bias the pedal 40 into a resting position in which it is not engaging a switch 104.

When a child applies pressure to a pedal 40, the pedal 40 pivots about its fulcrum point 102 and contacts and closes a switch 104. When a switch 104 is closed, a circuit is closed and the output generating system is activated to produce audible outputs, such as sounds, and/or visual outputs, such as lights.

Each of the keys 42 operates in a similar manner. Each key 42 is pivotally coupled to a rail 22 or 28 for movement to close a switch located underneath the particular key 42. When a switch below a key 42 is closed, the output generating system is activated.

Figure 4:
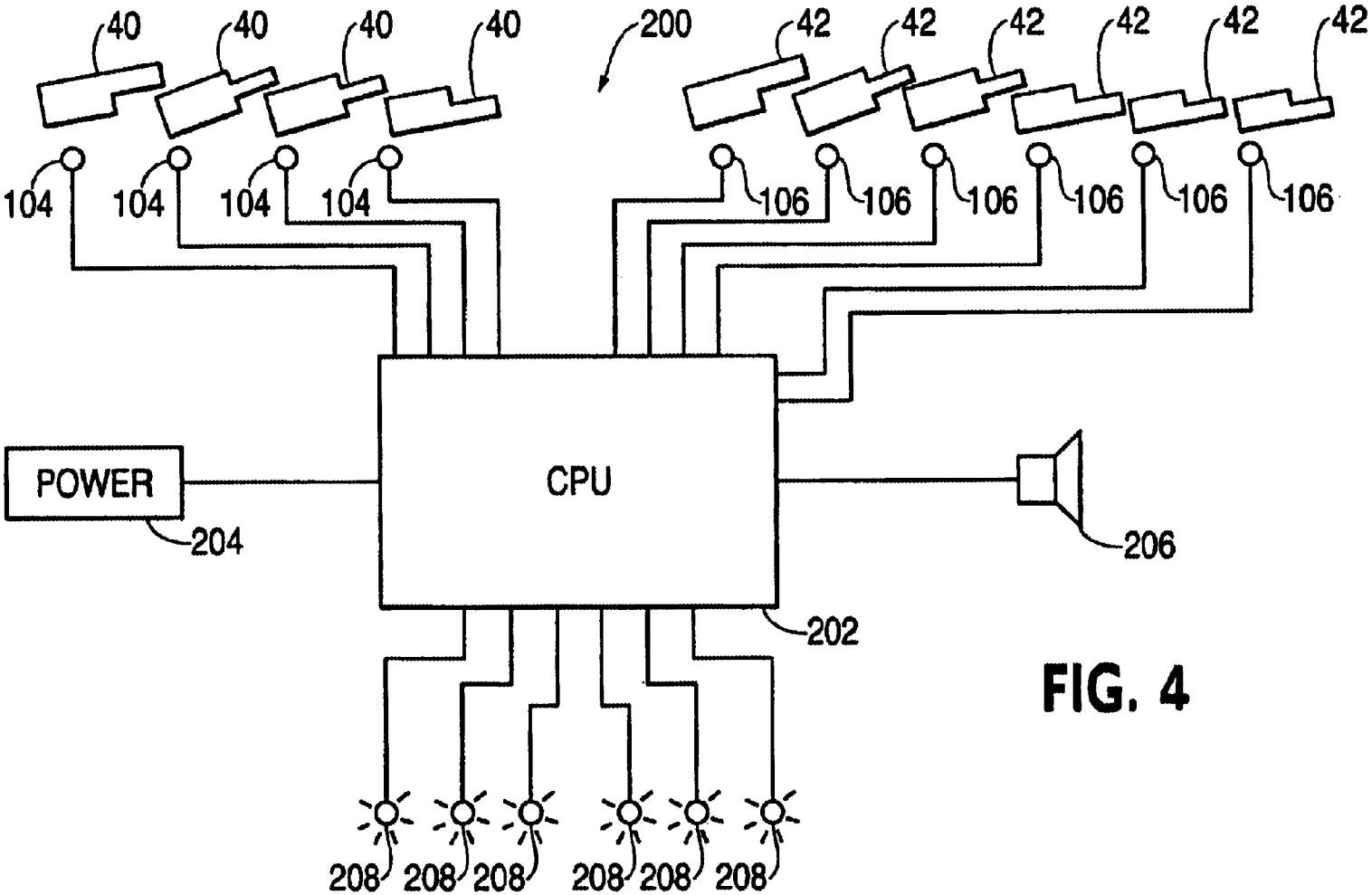
FIG. 4 illustrates a schematic of an output generating system according to the present invention.

FIG. 4 illustrates schematically an embodiment of an output generating system according to the present invention. In the illustrated embodiment, the output generating system generates outputs in response to inputs provided by a user. In one embodiment, the output generating system 200 is an electronic system that reproduces stored audio and light sequences.

In the illustrated embodiment, the output generating system 200 includes a conventional central processing unit (CPU) 202 in which electronic sounds and light sequences are stored. The CPU 202 is programmed to cause the sound and/or light output in response to the actuation of a switch on the toy 10. The CPU 202 is powered by a power source 204, which can be any conventional power source, such as a battery. The CPU 202 is programmed to cause audio signals to be sent to a speaker 206 and to cause electrical current to be sent to lights 208 on the toy 10.

In operation, when a user presses on a pedal 40, the corresponding switch 104 is closed and the CPU 202 transmits a stored sound pattern to the speaker 206 and a stored electrical signal pattern to one or more of the lights 208. Similarly, when a user presses a key 42, the corresponding switch 106 is closed and the CPU 202 transmits other predefined sequences of audio and visual outputs.

Returning to the seat assembly 30, the sliding feature of the seat assembly 30 is now described. As discussed above, the seat assembly 30 includes a seat frame 34 that slides along the rails 22 and 28 to enable the occupant of the seat assembly 30 to contact each pedal 40.

Figure 5:
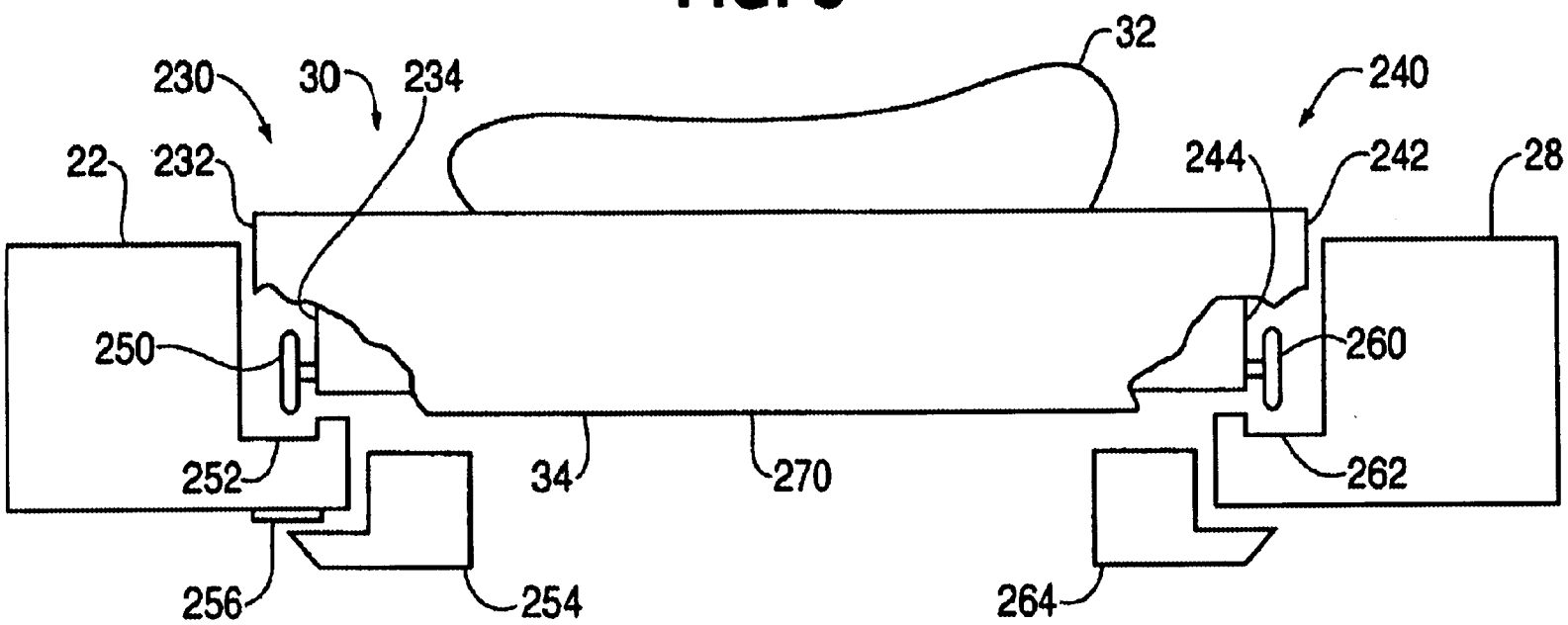
FIG. 5 illustrates an end view of the seat assembly of the entertainment toy of FIG. 1.

FIG. 5 illustrates an embodiment of the seat assembly 30 in accordance with the present invention. FIG. 5 illustrates the seat assembly 30 in a cutaway view. In the illustrated embodiment, the seat frame 34 includes a first rail engaging portion 230, a second rail engaging portion 240, and a bottom surface 270.

The seat frame 34 includes a first end 232 and a first internal surface 234 to which wheels 250 (only one shown) are coupled. The seat frame 34 also includes a second end 242 and a second internal surface 244 to which wheels 260 (only one shown) are coupled. The number of wheels 250 and 260 coupled to the seat frame 34 can vary.

In the illustrated embodiment, rail 22 includes a seat engaging portion 252 and rail 28 includes a seat engaging portion 262. The seat assembly 30 is configured to be located between the rails 22 and 28 and wheels 250 and 260 roll along seat engaging portions 252 and 262.

In one embodiment, the seat frame 34 includes stabilizers 254 and 264 that are removably coupleable to the bottom surface 270 of the seat frame 34. Stabilizers 254 and 264 prevent the seat assembly 30 from unintentionally disengaging from the rails 22 and 28. In one embodiment, the stabilizers 254 and 264 can be coupled to the scat frame 34 in any conventional manner, such as fasteners, adhesives, releasable snap-fit joints, etc.

In the illustrated embodiment, rails 22 and 28 include abutments proximate to the ends of rails 22 and 28 that limit the range of movement of the seat frame 34 along the rails 22 and 28. The abutments can be any type of protrusion or stop that prevents the wheels 250 and 260 from traveling off the end of the rails 22 and 28.

In one embodiment, rail 22 includes a movable abutment 256 that can be moved from a position that prevents the seat frame from disengaging from the rails 22 and 28 to a position that allows the seat frame 34 to be removed from the rails 22 and 28. The abutment 256 can be a conventional spring-loaded button that protrudes from a lower surface of rail 22. In an alternative embodiment, a separate abutment 256 can be placed on each rail 22 and 28. In this arrangement, the abutments 256 are depressed simultaneously in order to remove the seat assembly 30.

In operation, the occupant of the seat 30 can push on the base 12 to roll the wheels 250 and 260 along the seat engaging portions 252 and 262. Thus, the occupant can access every pedal 40 on the base 12. Once the child is capable of walking, the seat frame 34 can be removed from the frame 15 and the child can walk freely between the rails 22 and 28.

In the illustrated embodiment, the toy 10 includes a swivel mechanism that allows the child 100 to pivot while seated in the seat 32. This mechanism allows the child 100 to spin around so as to face either rail 20. Because the child can access both rails 20 instead of just one, additional amusement devices 36 can be placed on the toy 10.

Figure 6:
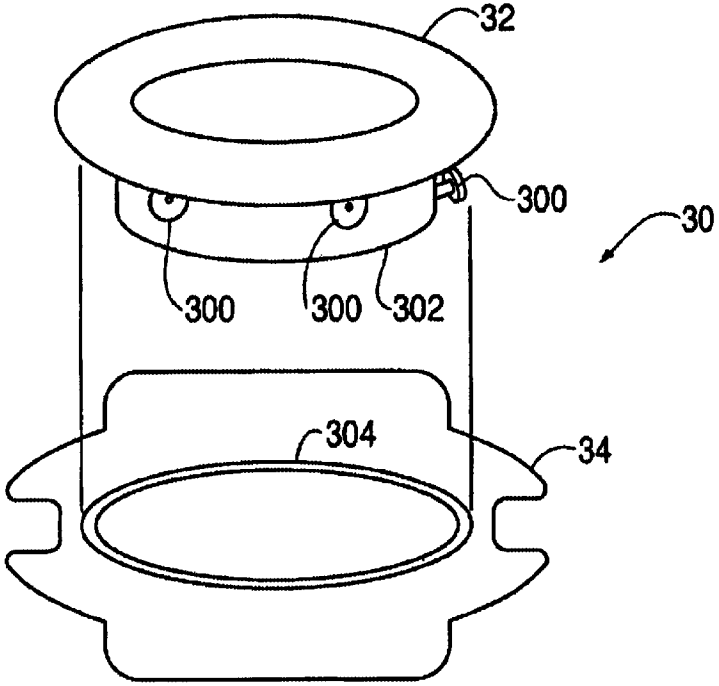
FIG. 6 illustrates an exploded perspective view of a swivel mechanism of the entertainment toy of FIG. 1.

FIG. 6 illustrates a swivel mechanism in accordance with the present invention. The seat assembly 30 is illustrated in an exploded perspective view in FIG. 6. In the illustrated embodiment, the seat 32 includes several wheels 300 coupled to the outer surface along a perimeter of an undercarriage 302. The seat 302 is coupled to the undercarriage 302 in any conventional manner, such as openings in the material of the seat 32 receiving protrusions or tabs on the undercarriage 302.

The seat frame 34 includes a circular groove 304 in which the wheels 300 of the undercarriage 302 travel. The circular groove 304 is sized to receive the wheels 300 and allow them to rotate freely. This arrangement allows the seat 32 to rotate within the seat frame 34. In operation, a child 100 can move the seat in a circular fashion to access either rail 22 or 28.

Figure 7:
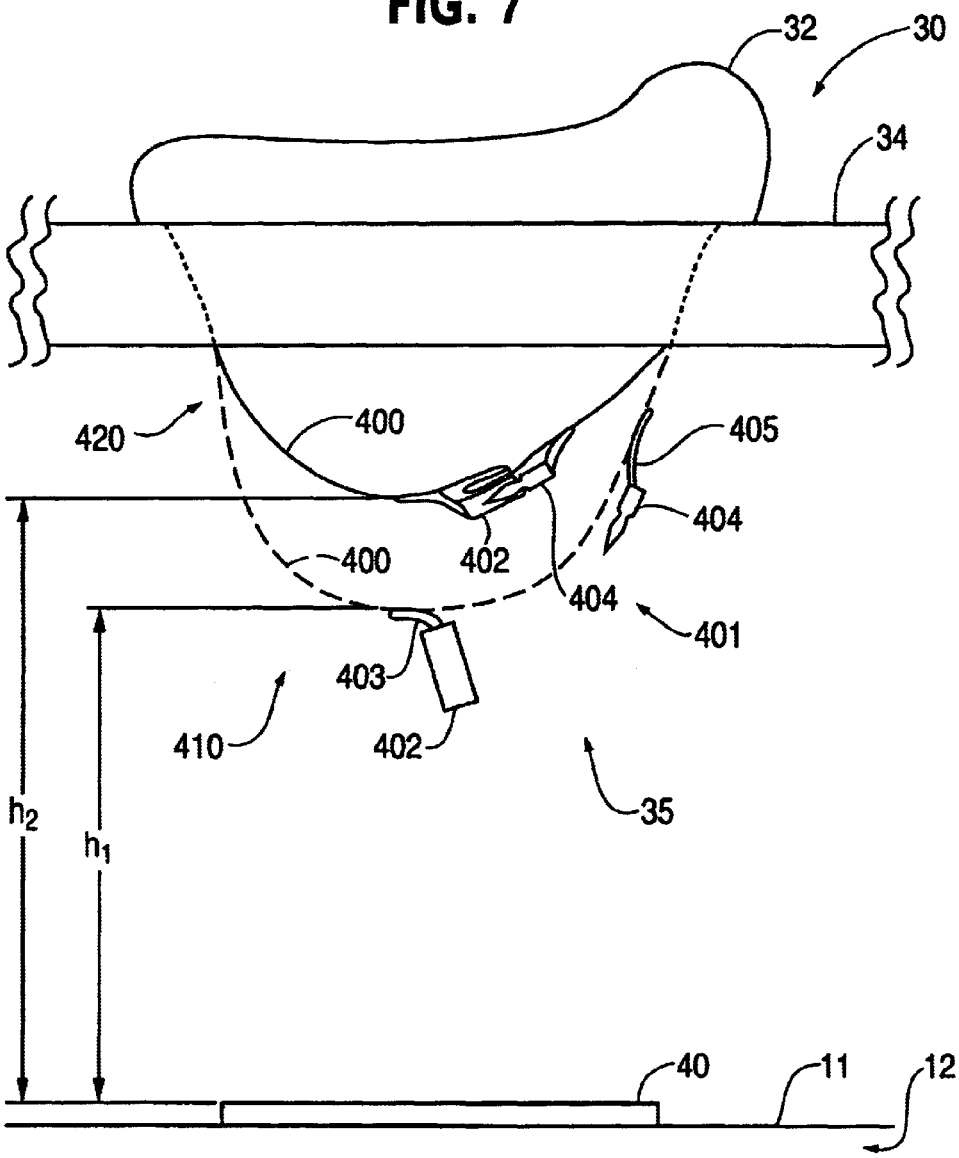
FIG. 7 illustrates a side view of the height adjustment mechanism of the seat assembly of the entertainment toy of FIG. 1 in multiple configurations.

FIG. 7 illustrates a height adjustment mechanism in accordance with the present invention. In the illustrated embodiment, the seat assembly 30 includes a height adjustment mechanism 35 that can be adjusted to vary the height of the seat 32 relative to the base 12 and pedals 40. The height of the seat 32 can be adjusted to allow the feet of an occupant of the seat 32 to engage the pedals 40 regardless of the height of the occupant.

In the illustrated embodiment, the seat 32 includes a weightbearing portion 400 for supporting the occupant of the seat 32. In one embodiment, the weightbearing portion 400 is a flexible fabric material with sufficient strength to support the occupant. The weightbearing portion 400 can be positioned in multiple configurations using the height adjustment mechanism 35. The height adjustment mechanism 35 allows for adjustment of the weightbearing portion 400 to meet the various height requirements.

In the illustrated embodiment, the height adjustment mechanism 35 includes a buckle 401 that includes a female portion 402 and a male portion 404 coupled spaced from each other on the weightbearing portion 400. Female portion 402 is coupled to a strap 403 that is attached to the weightbearing portion 400. Similarly, male portion 404 is coupled to a strap 405 that is attached to the weightbearing portion 400. In one embodiment, straps 403 and 405 are adjustable.

When the female portion 402 and male portion 404 are separated, the weightbearing portion 400 is in a first configuration 410 in which the weightbearing portion 400 is loose and its bottom surface sits in a first position at height h, relative to the actuators 40. When the female portion 402 and male portion 404 are connected, the weightbearing portion 400 is in a second configuration 420 in which the weightbearing portion 400 is adjusted to a second position at height $h_2$.

In operation, small occupants can be seated at height ho, with their feet close to or in contact with the pedals 40. As children grow, they can be seated at a greater height $h_2$ in order to remain a comfortable distance from the pedals 40.

In alternative embodiments, the female portion 402 and /or male portion 404 can themselves be adjusted so as to allow the weightbearing portion 400 to assume any height between $h_1$ and $h_2$. Thus, the toy 10 can be disposed in several different configurations to accommodate children of various sizes and ages.

In alternative embodiments, the height adjustment mechanism can be any other device that retains the material of the weightbearing portion 400 in multiple configurations. For example, any clasping or tightening mechanism can be employed. In one example, a button can be coupled to the weightbearing portion 400 and a corresponding slot formed in the material at a different location. Inserting the button into the slot can raise the weightbearing portion 400.

In alternative embodiments, the output generating system can produce any type of predefined sound pattern and/or light pattern. For example, the audible outputs can include single notes or a song. Similarly, in alternative embodiments, lights 208 can be placed within or underneath the keys 42 and/or pedals 40 so as to illuminate them when they are pressed. Alternatively, lights 208 can be placed within the amusement devices 36 to add to their entertainment effect.

Although the support frame 15 has been illustrated as having two supports that are linear and parallel to enable linear movement of the seat assembly 30 with respect to the output generating system on the base, other support frame configurations are contemplated. Two parallel supports could be circular (concentric), arcuate or of any other geometry to provide for non-linear movement of the seat assembly 30. Alternatively, the seat assembly could be fixed with respect to the base while the output generating system could be mounted for movement with respect to the base, so that the user could move the output generating system to access different actuators. Alternatively, movement of the seat assembly 30 with respect to the base could be achieved by fixing the seat assembly 30 to the support frame 15 and by moveably coupling the support frame 15 to the base.

Although the actuators 40 are disclosed above as mechanical keys mounted for movement with respect to the bases, many other possible configurations for actuators 40 are possible. For example, the actuators 40 could be membrane switches, or other non-moving actuators for detecting contact and/or movement by the user's feet, such as one or more touch pads.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. An entertainment toy for a child, comprising:

a base having an upper surface;

a support frame coupled to said base;

a seat configured to hold an infant, said seat being movably mounted on said support frame;

an output generating system; and an actuator disposed on said base and connected to said output generating system, said actuator being disposed to be engaged by a foot of an infant located in said seat, said output generating system generating an output in response to manipulation of said actuator, said entertainment toy having, a first configuration in which said seat is supported on said support frame and a second configuration in which said seat is removed from said support frame.

2. The entertainment toy of claim 1, wherein said support frame includes a first rail and a second rail, and said seat is movably mounted on said first and second rails.

3. The entertainment toy of claim 1, wherein said seat is movable along and selectively disposable in a first position on said support frame and in a second position on said support frame spaced from said first position, said seat being disposable above said actuator in said first position.

4. The entertainment toy of claim 1, wherein said support frame includes a first frame portion and a second frame portion, said second frame portion being substantially parallel to said first frame portion, said seat being mounted for movement between said first frame portion and said second frame portion.

5. The entertainment toy of claim 1, wherein said seat includes a seat frame, a weightbearing portion, and a swivel mechanism, said swivel mechanism being configured to couple said seat frame and said weightbearing portion, said swivel mechanism enabling said weightbearing portion to rotate with respect to said support frame.

6. The entertainment toy of claim 1, wherein said seat is slidably mounted on and is configured to be removed from said support frame.

7. The entertainment toy of claim 1, wherein said seat includes a seat frame, a weightbearing portion coupled to said seat frame, and a height adjustment mechanism coupled to said weightbearing portion, said height adjustment mechanism being adjustable to retain the weightbearing portion at a plurality of different heights with respect to said upper surface.

8. An entertainment device comprising:

a base;

a frame, said frame coupled to said base;

a seat, said seat being removably coupled to said frame;

an output generating device; and an actuator, said actuator being connected to said output generating device and disposed on said base, wherein said seat is configured to be positioned above said actuator when coupled to said frame, and activation of said actuator causes said output generating device to generate an output, said entertainment device having a first configuration in which said seat is supported on said support frame and a second configuration in which said seat is removed from said support frame.

9. The entertainment device of claim 8, wherein said frame includes a first frame portion and a second frame portion, said seat includes a first side and a second side opposite said first side, said first side of said seat being coupled to said first frame portion and said second side of said seat being coupled to said second frame portion.

10. The entertainment device of claim 8, wherein said frame includes a first frame portion and a second frame portion, said second frame portion being substantially parallel to said first frame portion, said seat being mounted for movement with respect to said base between said first frame portion and said second frame portion.

11. The entertainment device of claim 10, wherein said first frame portion includes a first rail, said second frame portion includes a second rail, and said seat includes a first rail engaging portion and a second rail engaging portion, said first rail engaging portion configured to engage said first rail, said second rail engaging portion configured to engage said second rail.

12. The entertainment device of claim 8, wherein said base includes a plurality of apertures and said actuator includes a plurality of movable members, each of said plurality of movable members being disposed in one of said plurality of apertures.

13. The entertainment device of claim 12, wherein said actuator includes a plurality of switches, each of said plurality of switches being engageable by one of said plurality of movable members.

14. An entertainment device comprising:

a frame, said frame including a first rail and a second rail;

a seat, said seat being removably coupled to said first rail and said second rail; and a sound generating mechanism, said sound generating mechanism being disposed on said frame beneath said seat and being configured to be engaged by an occupant of said seat, said entertainment toy having a first configuration in which said seat is supported on said support frame and a second configuration in which said seat is removed from said support frame.

15. The entertainment device of claim 14, wherein said sound generating mechanism includes a plurality of actuators and a plurality of switches, each of said plurality of switches being associated with one of said plurality of actuators.

16. The entertainment device of claim 14, wherein said sound generating mechanism includes a plurality of actuators, each of said plurality of actuators resembling a piano key.

17. The entertainment device of claim 14, wherein said seat is slidably coupled to said first rail and said second rail.

18. The entertainment device of claim 14, wherein said frame includes an abutment disposed proximate to an end of said first rail.

19. The entertainment device of claim 18, wherein said abutment is movable between a first position and a second position, said seat engaging said abutment when said abutment is in said first position, and said seat passing said abutment when said abutment is in said second position to enable said seat to be removed from said rails.

20. An entertainment device comprising:

a base having an upper surface;

a first actuator and a second actuator disposed on said upper surface;

an output generating device operable coupled to said first actuator and said second actuator and capable of producing one or more of an audible output and a visual output in response to actuation of either of said first actuator and said second actuator;

a support frame including:

a first support coupled to and projecting upwardly from said base, and having a first linear support rail disposed on an upper end thereof;

a second support coupled to and projecting upwardly from said base, and having a second linear support rail disposed on an upper end thereof, said second linear support rail being disposed parallel to said first linear support rail;

a seat mounted to said support frame in spaced relation to said upper surface for movement along said support rails with respect to said actuators, said seat being removable from said support frame;

whereby a user disposed in said seat can move said seat to be selectively positioned above said first actuator or said second actuator and can actuate said first actuator or said second actuator with the user's foot.

21. The entertainment toy of claim 20, wherein said seat includes a seat frame, a weightbearing portion, and a swivel mechanism, said swivel mechanism being configured to couple said seat frame and said weightbearing portion, said swivel mechanism enabling said weightbearing portion to rotate with respect to said support frame.

22. The entertainment device of claim 20, wherein said base includes a plurality of apertures and each of said first actuator and said actuator includes a movable members, each of said movable members being disposed in one of said plurality of apertures.

23. The entertainment device of claim 20, wherein said frame includes an abutment disposed proximate to an end of said first rail, said abutment being movable between a first position and a second position, said seat being engageable with said abutment when said abutment is in said first position to prevent movement of said seat past said abutment, said seat being moveable past said abutment and removable from said first rail when said abutment is in said second position.

24. An entertainment toy for a child, comprising:

a base having an upper surface;

a support frame coupled to said base;

a seat configured to hold an infant, said seat being movably mounted on said support frame, the seat including a seat frame, a weightbearing portion, and a swivel mechanism, the swivel mechanism being configured to couple said seat frame and said weightbearing portion, the swivel mechanism enabling said weightbearing portion to rotate with respect to said support frame;

an output generating system; and an actuator disposed on said base and connected to said output generating system, said actuator being disposed to be engaged by a foot of an infant located in said seat, said output generating system generating an output in response to manipulation of said actuator.

25. An entertainment toy for a child, comprising:

a base having an upper surface;

a support frame coupled to said base;

a seat configured to hold an infant, said seat being movably mounted on said support frame, the seat including a seat frame, a weightbearing portion coupled to the seat frame, and a height adjustment mechanism coupled to the weightbearing portion, the height adjustment mechanism being adjustable to retain the weightbearing portion at a plurality of different heights with respect to the upper surface;

an output generating system; and an actuator disposed on said base and connected to said output generating system, said actuator being disposed to be engaged by a foot of an infant located in said seat, said output generating system generating an output in response to manipulation of said actuator.

* * * * *